US010677137B2

(12) United States Patent
Lee et al.

(10) Patent No.: US 10,677,137 B2
(45) Date of Patent: Jun. 9, 2020

(54) MOTOR ENGINE HAVING AN OXYGEN SENSOR

(71) Applicant: SOUTHERN TAIWAN UNIVERSITY OF SCIENCE AND TECHNOLOGY, Tainan (TW)

(72) Inventors: Cho-Yu Lee, Tainan (TW); Shien-Yueh Chang, Tainan (TW)

(73) Assignee: SOUTHERN TAIWAN UNIVERSITY OF SCIENCE AND TECHNOLOGY, Tainan (TW)

( * ) Notice: Subject to any disclaimer, the term of this patent is extended or adjusted under 35 U.S.C. 154(b) by 5 days.

(21) Appl. No.: 15/819,904

(22) Filed: Nov. 21, 2017

(65) Prior Publication Data

US 2019/0153924 A1 May 23, 2019

(51) Int. Cl.

| | |
|---|---|
| ***F01N 13/00*** | (2010.01) |
| ***F02F 1/06*** | (2006.01) |
| ***F01P 1/02*** | (2006.01) |
| ***F02F 1/32*** | (2006.01) |
| ***F02F 1/24*** | (2006.01) |

(52) U.S. Cl.

CPC ..... *F01N 13/008* (2013.01); *F01P 1/02* (2013.01); *F02F 1/06* (2013.01); *F02F 1/24* (2013.01); *F02F 1/32* (2013.01); *F01N 2560/025* (2013.01); *F01P 2001/023* (2013.01)

(58) Field of Classification Search

CPC combination set(s) only.
See application file for complete search history.

(56) References Cited

U.S. PATENT DOCUMENTS

| | | | | |
|---|---|---|---|---|
| 7,552,586 B1 * | 6/2009 | White | ..... | F01N 3/08 440/89 B |
| 2018/0051617 A1 * | 2/2018 | Sasaki | ..... | F01N 3/24 |

* cited by examiner

*Primary Examiner* — Stephen K Cronin
*Assistant Examiner* — Ruben Picon-Feliciano
(74) *Attorney, Agent, or Firm* — Muncy, Geissler, Olds & Lowe, P.C.

(57) ABSTRACT

A motor engine having an oxygen sensor is provided, including: a cylinder head, including a main body and a protruding tube protruding outwardly from the main body, the main body including a first end portion, a second end, and a combustion chamber, the protruding tube having a protrusive receptacle protruding outwardly therefrom, the main body defining an axial direction; an exhaust passage, communicated with the combustion chamber and the protruding tube; an oxygen sensor, inserted into the protrusive receptacle, including a sensing portion which is inserted into the exhaust passage; wherein as viewed in a lateral direction of the cylinder head, two surfaces of the main body along the axial direction disposed on two opposite sides defines two boundary lines, the oxygen sensor and the main body are in an overlapping arrangement and does not protrude out of the two boundary lines.

10 Claims, 9 Drawing Sheets

MOTOR ENGINE HAVING AN OXYGEN SENSOR

BACKGROUND OF THE INVENTION

Field of the Invention

The present invention relates to a motor engine having an oxygen sensor.

Description of the Prior Art

In response to environmental protection, most motors are assembled with a catalytic converter, so as to converts toxic gases and pollutants in exhaust gas to less an incomplete combustion. Then, an oxygen detector can detect a conversion efficiency of catalytic converter so as to maintain the engine in the best running condition. Thus, it can reduce the pollution of air and increase a durability of engine.

Because of the oxygen sensor need to be high temperature to a content temperature to detect oxygen content. Thus, most oxygen sensors are disposed on the exhaust opening of exhaust cylinder of the engine, where the engine has a high temperature to speed up the temperature of the oxygen sensor. However, the conditional oxygen sensor used to be disposed on the cylinder of engine, and extending out of the engine cover resulting in an increase in a size of the engine.

The present invention is, therefore, arisen to obviate or at least mitigate the above mentioned disadvantages.

SUMMARY OF THE INVENTION

An object of the present invention is to provide a motor engine having an oxygen sensor, in which the motor engine having an oxygen sensor decreases size.

To achieve the above and other objects, a motor engine having an oxygen sensor is provided, including: a cylinder head, including a main body and a protruding tube protruding outwardly from the main body, the main body including a first end portion configured to be assembled a transmission gear assembly, a second end portion disposed opposite to the first end portion, and a combustion chamber, the second end portion configured to be assembled a cylinder, the protruding tube having a protrusive receptacle protruding outwardly therefrom, the main body defining an axial direction passing through the first end portion and the second end portion; an exhaust passage, communicated with the combustion chamber and the protruding tube; an oxygen sensor, inserted into the protrusive receptacle, including a sensing portion which is inserted into the exhaust passage; wherein as viewed in a lateral direction of the cylinder head, the main body has two lateral surfaces disposed on the two opposite sides along the axial direction, the main body defines two boundary lines respectively at least extending along the two lateral surfaces, the oxygen sensor and the main body are in an overlapping arrangement and the oxygen sensor does not protrude out of the two boundary lines.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
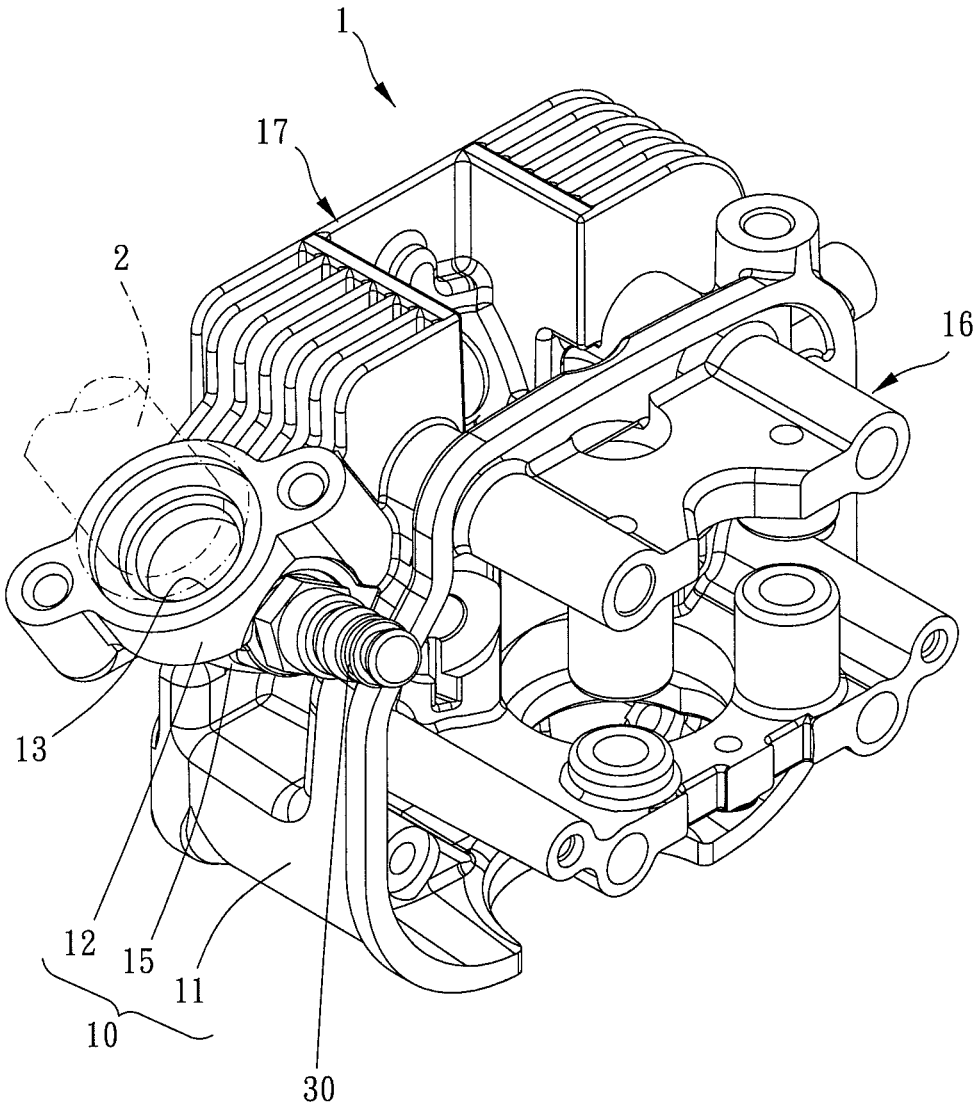
FIG. 1 is a perspective view of a motor engine having an oxygen sensor according to a first preferred embodiment of the present invention.
Figure 2:
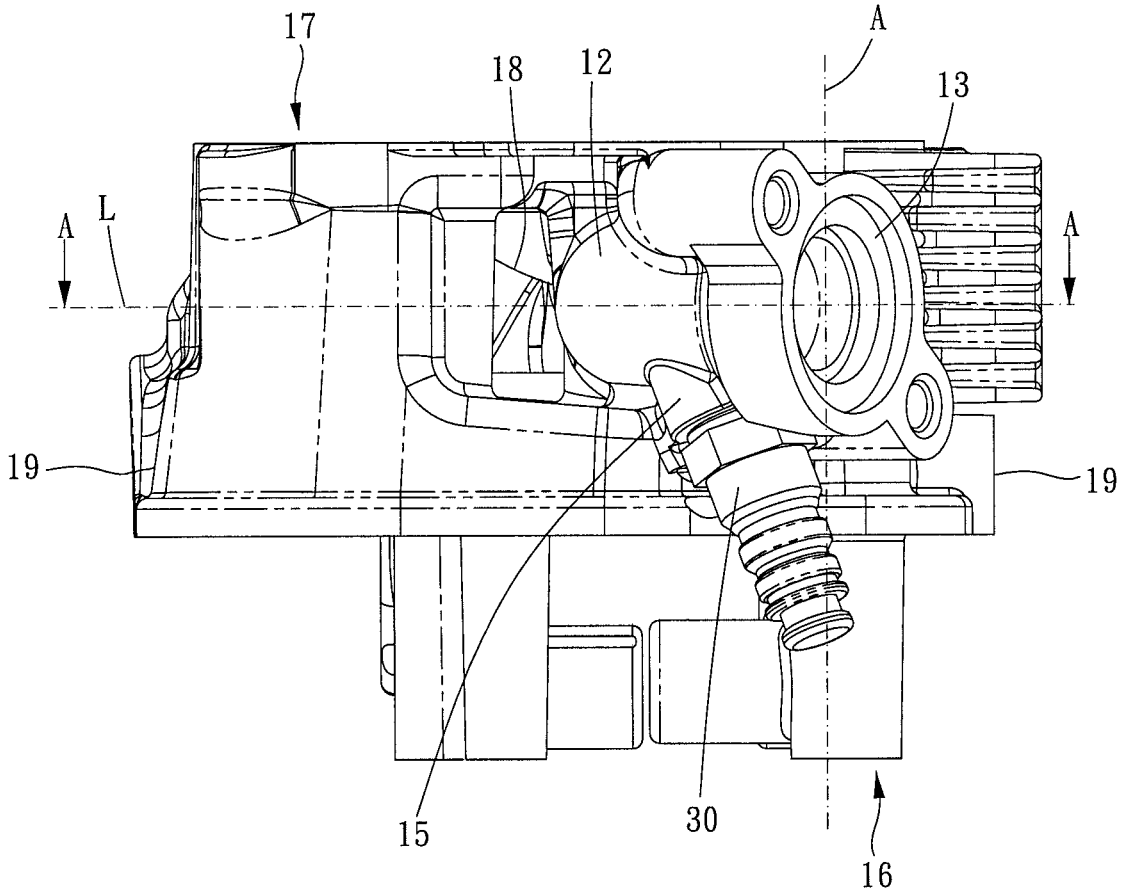
FIG. 2 is a side view of a motor engine having an oxygen sensor according to the first preferred embodiment of the present invention.
Figure 3:
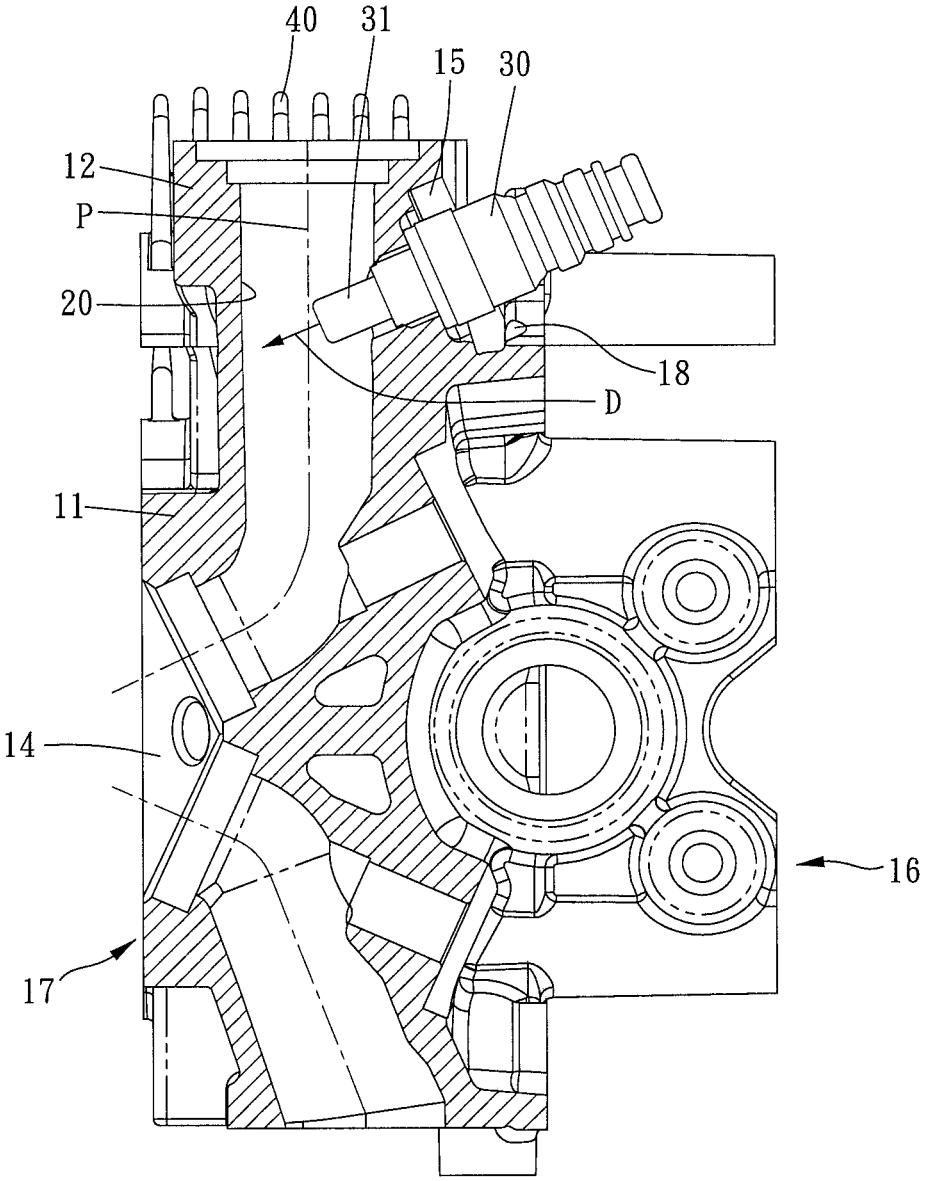
FIG. 3 is a cross-sectional view along the line A-A of FIG. 2.

FIGS. 1 to 3 show a motor engine having an oxygen sensor to a first preferred embodiment of the present invention. The motor engine having an oxygen sensor includes a cylinder head 10, an exhaust passage 20, and an oxygen sensor 30.

The cylinder head 10 includes a main body 11 and a protruding tube 12 protruding outwardly from the main body 11. The main body 11 and the protruding tube 12 being integrally formed of one piece. The main body 11 includes a first end portion 16 configured to be assembled to a transmission gear assembly (not shown), a second end portion 17 disposed opposite to the first end portion 16, and a combustion chamber 14. The second end portion 17 is configured to be assembled to a cylinder (not shown). The main body 11 defines an axial direction A passing through the first end portion 16 and the second end portion 17.

The protruding tube 12 has an exhaust opening 13 at downstream of the exhaust passage 20, the exhaust opening 13 is configured to be connected with an exhaust tube 2. The protruding tube 12 has a protrusive receptacle 15 protruding outwardly therefrom. The exhaust passage 20 is communicated with the combustion chamber 14 and the protruding tube 12. The oxygen sensor 30 is inserted into the protrusive receptacle 15, the oxygen sensor 30 includes a sensing portion 31 which is inserted into the exhaust passage 20. Wherein as viewed in a lateral direction of the cylinder head 10, the main body 11 has two lateral surfaces disposed on the two opposite sides along the axial direction A, the main body 11 defines two boundary lines 19 respectively at least extending along the two lateral surfaces, the oxygen sensor 30 and the main body 11 are in an overlapping arrangement, and the oxygen sensor 30 does not protrude out of the two boundary lines 19. Specifically, the two boundary lines 19 of the main body 11 are two outlines of the main body 11 disposed on the two opposite sides along the axial direction A. Thereby, it not only can reduce the size of the motor engine, but also can accurately detect the oxygen concentration of exhaust gas. The protruding tube 12 protrudes outwardly relative to an outer surface of the cylinder head 10, as viewed in the axial direction A the oxygen sensor 30 is overlapped with the protruding tube 12 and does not protrude out of the protruding tube 12.

Figure 4:
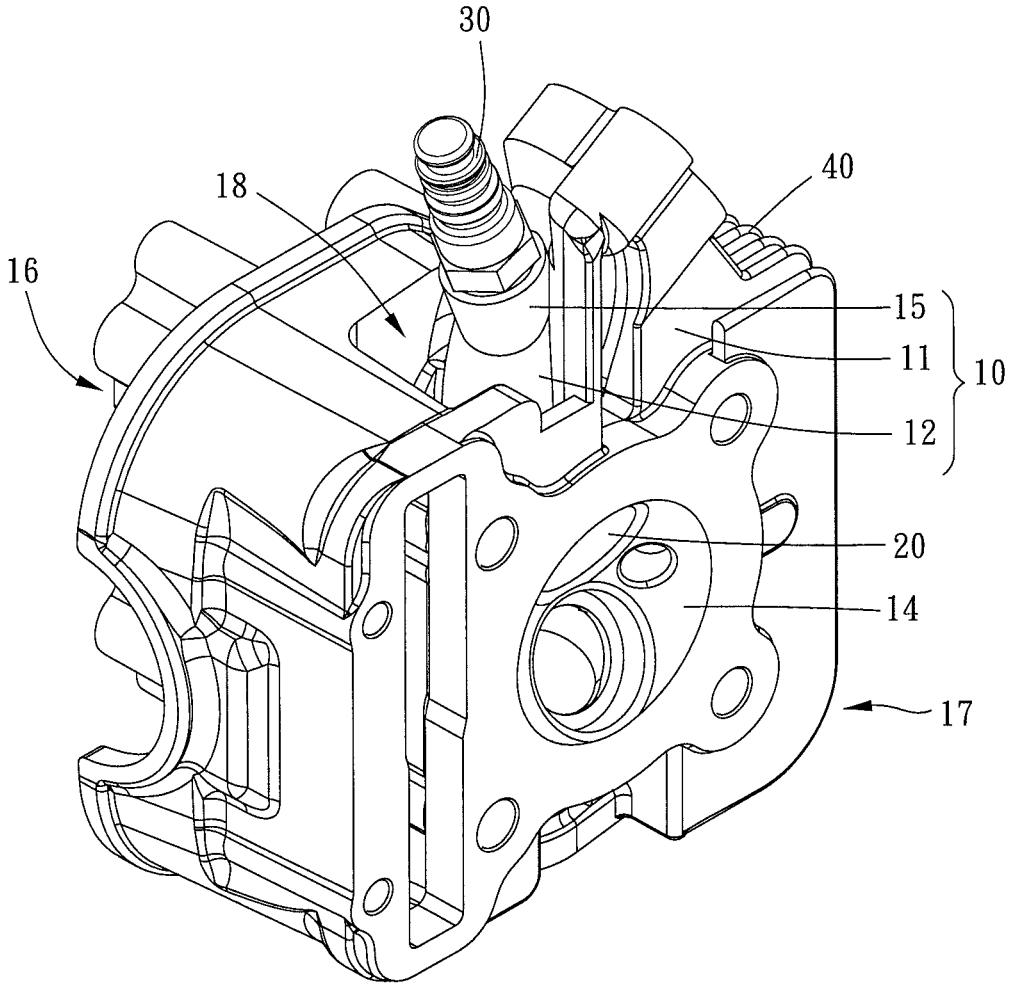
FIG. 4 is a perspective view of a motor engine having an oxygen sensor according to a second preferred embodiment of the present invention.
Figure 5:
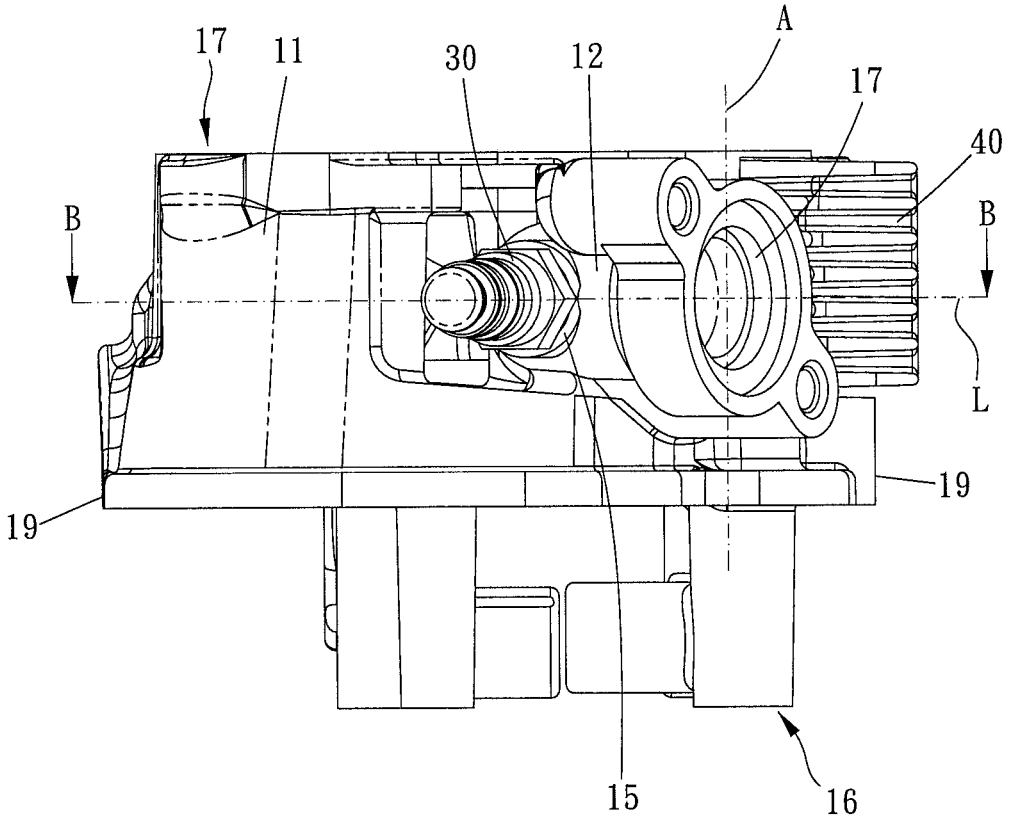
FIG. 5 is a side view of a motor engine having an oxygen sensor according to the second preferred embodiment of the present invention.
Figure 6:
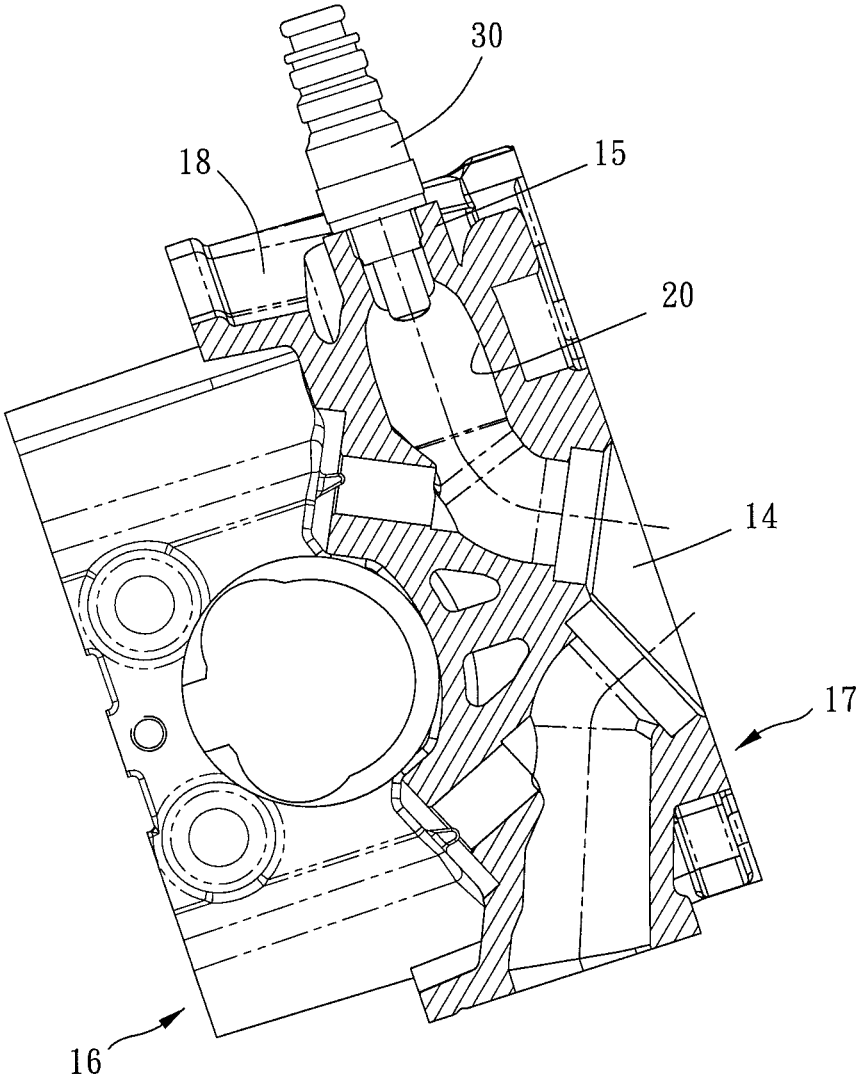
FIG. 6 is a cross-sectional view along the line B-B of FIG. 5.

In this embodiment, the oxygen sensor 30 has an outer portion out of the exhaust passage 20. The outer portion extends towards the first end 16 and overlaps the first end 16. Specifically, a central axial of the oxygen sensor 30 is transverse to the axial direction A of the main body 11. Besides, the axial direction A of the main body 11 passes through an exhaust opening 13 of the protruding tube 12. The main body 11 further defines a longitudinal direction L passing through the exhaust opening 13 and being perpendicular to the axial direction A, and the oxygen sensor 30 is disposed in a range of a second quadrant to a fourth quadrant, so as to reduce the size of the motor engine, and be electronically connected with a micro-computer controller (not shown) easily. As shown in FIG. 3 of first preferred embodiment, the oxygen sensor 30 is disposed in the third quadrant, and extents to the fourth quadrant. Furthermore, please refer to FIGS. 4-6 for the second preferred embodiment of the present invention, the oxygen sensor 30 is disposed between the third and second quadrant.

The exhaust passage 20 defines an exhaust path P from the combustion chamber 14 which is disposed at upstream to the protruding tube 12 which is disposed at downstream. The sensing portion 31 of the oxygen sensor 30 defines a pointing direction D which is transverse to the exhaust path P, and the pointing direction D points towards upstream of the exhaust passage 20, so as to improve the accuracy of the detection of oxygen concentration of exhaust gas. In this embodiment, the oxygen sensor 30 inserts slantly into the protruding tube 12.

In this embodiment, the protrusive receptacle 15 is a tube and disposed around part of the oxygen sensor 30 to provide support, and to prevent the oxygen sensor 30 from detaching by outer force and the damage of the protruding tube 12. Besides, an extending direction of the protrusive receptacle 15 is transverse to exhaust path P, so as to decrease the size. Preferably, the protrusive receptacle 15 is connected with the main body 11 to strong strength of the structure.

Specifically, the main body 11 has a concave 18, at least part of the protruding tube 12 exposes the concave 18. The protrusive receptacle 15 is disposed on the part of the protruding tube 12 which exposes the concave 18, so as to decrease the size. Preferably, the concave 18 depresses inwardly towards the exhaust passage 20 so that the sensing portion 31 of the oxygen sensor 30 can close to the combustion chamber 14, to improve the accuracy of the detection of the oxygen sensor 30. The protrusive receptacle 15 is disposed between the exhaust opening 13 and the concave 18 and within the concave 18.

A periphery of the main body 11 further includes a plurality of heat-dissipation structures 40. The plurality of heat-dissipation structures 40 are connected with the protruding tube 12, so as to improve an efficiency of the heat dissipation. In this embodiment, each of the heat-dissipation structures 40 is a heat-dissipation sheet, the plurality of heat-dissipation structures 40 are disposed separately, so as to improve an efficiency of the heat dissipation.

Figure 7:
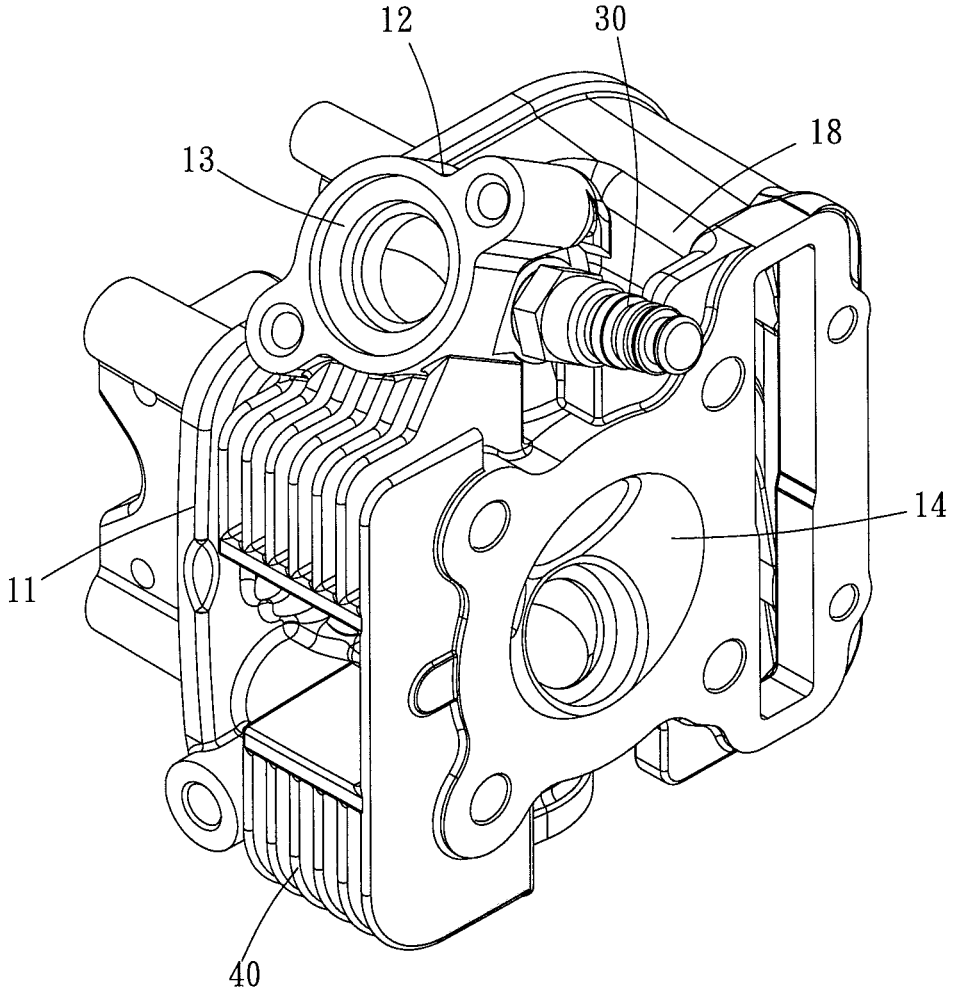
FIG. 7 is a perspective view of a motor engine having an oxygen sensor according to a third preferred embodiment of the present invention.
Figure 8:
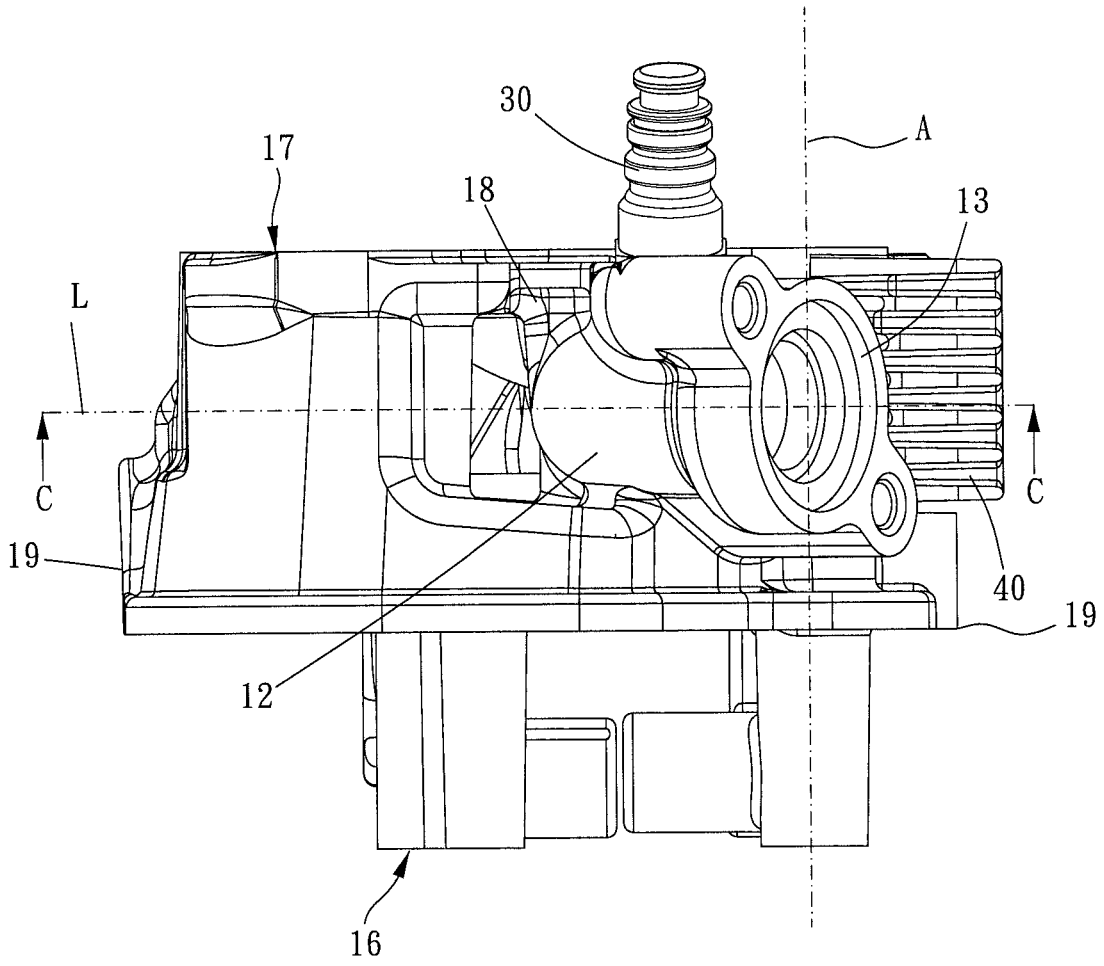
FIG. 8 is a side view of a motor engine having an oxygen sensor according to the third preferred embodiment of the present invention.
Figure 9:
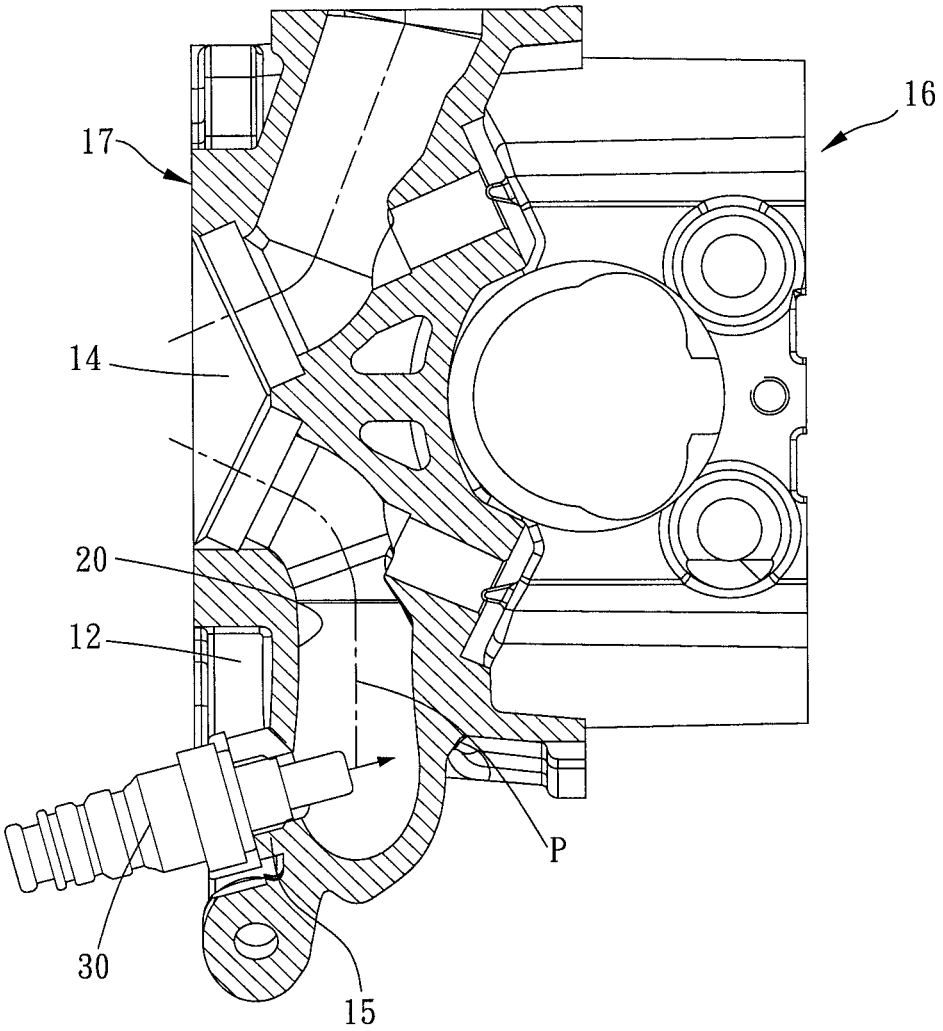
FIG. 9 is a cross-sectional view along the line C-C of FIG. 8.

Please refer to FIGS. 7-9 for the third preferred embodiment of the present invention, the different from the first preferred embodiment is that, the oxygen sensor 30 extends towards the first end portion 17 and protrudes out of the first end portion 17. When the first end portion 17 of the cylinder head 10 is configured to be assembled the cylinder, the oxygen sensor 30 and the cylinder are overlapped. Thus, it does not increase the size of the motor engine with the oxygen sensor 30.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A motor engine having an oxygen sensor, including: a cylinder head, including a main body and a protruding tube protruding outwardly from the main body, the main body and the protruding tube being integrally formed of one piece, the main body including a first end portion configured to be assembled to a transmission gear assembly, a second end portion disposed opposite to the first end portion, and a combustion chamber, the second end portion configured to be assembled to a cylinder, the protruding tube having a protrusive receptacle protruding outwardly therefrom, the main body defining an axial direction passing through the first end portion and the second end portion;

an exhaust passage, communicated with the combustion chamber and the protruding tube;

wherein the oxygen sensor is inserted into the protrusive receptacle of the protruding tube, the oxygen sensor includes a sensing portion which is inserted into the exhaust passage;

wherein as viewed in a lateral direction of the cylinder head, the main body has two lateral surfaces disposed on the two opposite sides along the axial direction, the main body defines two boundary lines respectively at least extending along the two lateral surfaces, the oxygen sensor and the main body are in an overlapping arrangement and the oxygen sensor does not protrude out of the two boundary lines;

wherein the protruding tube has an exhaust opening at downstream of the exhaust the exhaust opening is configured to be connected with an exhaust tube;

wherein the protruding tube protrudes outwardly relative to an outer surface of the cylinder head, as viewed in the axial direction the oxygen sensor is overlapped with the protruding tube and does not protrude out of the protruding tube.

2. The motor engine having an oxygen sensor of claim 1, wherein the exhaust passage defines an exhaust path from the combustion chamber which is disposed at upstream to the protruding tube which is disposed at downstream, the sensing portion of the oxygen sensor defines a pointing direction which is transverse to the exhaust path, and the pointing direction points towards upstream of the exhaust passage.

3. The motor engine having an oxygen sensor of claim 1, wherein the protrusive receptacle is connected with the main body.

4. The motor engine having an oxygen sensor of claim 1, wherein a central axial of the oxygen sensor is transverse to the axial direction.

5. The motor engine having an oxygen sensor of claim 1, wherein the axial direction passes through an exhaust opening of the protruding tube, the main body further defines a longitudinal direction passing through the exhaust opening and being perpendicular to the axial direction, and the oxygen sensor is disposed in a range of a second quadrant to a fourth quadrant.

6. The motor engine having an oxygen sensor of claim 1, wherein the main body has a concave, at least part of the protruding tube exposes the concave, and the protrusive receptacle is disposed on the part of the protruding tube which exposes the concave.

7. The motor engine having an oxygen sensor of claim 6, wherein the concave depresses inwardly towards the exhaust passage, and the protruding tube protrudes outwardly beyond the concave: wherein the protrusive receptacle is disposed between the exhaust opening and the concave and within the concave.

8. The motor engine having an oxygen sensor of claim 1, wherein a periphery of the main body has a plurality of heat-dissipation structures, and the plurality of heat-dissipation structures are connected with the protruding tube.

9. The motor engine having an oxygen sensor of claim 7, wherein the exhaust passage defines an exhaust path from the combustion chamber which is disposed at upstream to the protruding tube which is disposed at downstream, the sensing portion of the oxygen sensor defines a pointing direction which is transverse to the exhaust path, the pointing direction points towards upstream of the exhaust passage; the protrusive receptacle is connected with the main body; a central axial of the oxygen sensor is transverse to the axial direction of the main body; the axial direction of the engine cylinder head passes through an exhaust opening of the protruding tube, the main body further defines a longitudinal direction passing through the exhaust opening and is perpendicular to the axial direction, the oxygen sensor is disposed in a range of a second quadrant to a fourth quadrant; a periphery of main body further includes a plurality of heat-dissipation structures, the plurality of heat-dissipation structures are disposed on the main body and connected with the protruding tube; the protruding tube has an exhaust opening disposed at the downstream of the exhaust passage; each of the heat-dissipation structures is a heat-dissipation sheet; and the protrusive receptacle is a tube and disposed around part of the oxygen sensor, and an extending direction of the protrusive receptacle is transverse to exhaust path.

10. The motor engine having an oxygen sensor of claim 1, wherein as viewed in a lateral direction of the cylinder head, the oxygen sensor extends towards the second end portion and protrudes out of the second end portion.

* * * * *